US005868028A

United States Patent [19]

Kuroda

[11] Patent Number: 5,868,028

[45] Date of Patent: Feb. 9, 1999

[54] BAND-LIKE CLOTH TWIST DETECTING DEVICE AND TWIST ELIMINATING MACHINE

[75] Inventor: Mituru Kuroda, Kyoto, Japan

[73] Assignee: Sanki Industry Co. Ltd., Kyoto-fu, Japan

[21] Appl. No.: 889,443

[22] Filed: Jul. 8, 1997

[30] Foreign Application Priority Data

Jul. 8, 1996 [JP] Japan ..... 8-198438

[51] Int. Cl.[6] ..... G01L 5/04

[52] U.S. Cl. ..... 73/160; 57/1 UN

[58] Field of Search ..... 73/159, 160, 808; 57/1 UN, 2.3, 2.5

[56] References Cited

U.S. PATENT DOCUMENTS

| | | | |
|---|---|---|---|
| 3,813,862 | 6/1974 | Tsuchida | 57/1 UN |
| 4,106,004 | 8/1978 | Kuroda | 57/1 UN |
| 4,631,911 | 12/1986 | Young, Jr. et al. | 73/159 |
| 4,843,879 | 7/1989 | Enderlin et al. | 73/160 |
| 5,271,131 | 12/1993 | Jacumin | 57/1 UN |

*Primary Examiner*—Max H. Noori
*Attorney, Agent, or Firm*—Lane, Aitken & McCann

[57] ABSTRACT

A twist detecting device is capable of detecting twist of band-like cloth even though the thickness of the band-like cloth is changed, and a twist eliminating machine incorporates the twist detecting device. The twist detecting device is constructed so that cloth contactors 3*a,* 3*b* are supported by a pair of supporting axes 2*a,* 2*b,* the arcuate contacting portion r of these cloth contactors is brought into contact with band-like cloth w1 or w2, the respective cloth contactors 3*a,* 3*b* are caused to rock and to be displaced around their supporting axes by engagement with wrinkle lines of the band-like cloth, and the rocking and displacement are detected as twist information, wherein a cloth intermediate contacting member which is able to detect to the twist of band-like cloth is rockably provided around an intermediate supporting axis 13 juxtaposed between pair of supporting axes deep in a triangle-shaped space formed at the opposed sides of the arcuate contacting member of pair of cloth contactor, so that the cloth intermediate contacting member 12 is caused to rock and to be displaced around the intermediate supporting axes by engagement with the cloth contactors, and the rocking and displacement are detected as twist information of the band-like cloth.

10 Claims, 4 Drawing Sheets

BAND-LIKE CLOTH TWIST DETECTING DEVICE AND TWIST ELIMINATING MACHINE

FIELD OF THE INVENTION

The present invention relates to a twist detecting device capable of detecting twist produced at band-like cloth turned rope-like by narrowing the width thereof, during a feeding movement thereof, and relates to a twist eliminating machine incorporating the twist detecting device.

BACKGROUND OF THE INVENTION

Generally, natural twists rightward or leftward in the lengthwise direction of band-like cloth irregularly occur when dyeing or washing the band-like cloth. It is necessary to continuously eliminate the twists when spreading the band-like cloth.

Therefore, the present applicant has designed and been manufacturing a twist eliminating machine represented by a machine disclosed by Japanese Patent Publication No. 19793 of 1979, and the outline thereof is described below.

That is, as shown in FIG. 4, 1 is a cloth guide wheel which is able to guide so as to cause band-like cloth w turned rope-like by narrowing the same to go upward and continuously go down.

2*a* and 2*b* are supporting axes juxtaposed to each other, 3*a* and 3*b* are spherical cloth contactors supported by each of the supporting axes 2*a*, 2*b*, and they function as a twist detecting device of the band-like cloth w.

4 is a cloth turning device which consists of a cylindrical rotating member 4 rotatably retained around a vertical axis and a motor 4*b* for causing the rotating member 4 to rotate.

When using the twist eliminating machine, the band-like cloth w turned rope-like by narrowing is upwardly inserted into an inner hole of the cylindrical rotating member 4 from its lower side, and continuously is caused to go down with the same applied to the cloth guide wheel 1. Thereafter, the band-like cloth is guided so as to be brought into contact with the arcuate contacting member r of a pair of cloth contactors, and a tensile force f1 is given to the point of the band-like cloth, wherein the band-like cloth is fed and supplied.

Thereby, the band-like cloth w will move with the wrinkle lines thereof being brought into contact with the arcuate contacting member r of the cloth contactors 3*a*, 3*b*. At this time, if any twist exists on the band-like cloth w, the wrinkle lines are inclined in a fixed direction, thereby causing an engaging force to be generated between the wrinkle lines and a number of longitudinal grooves m of the arcuate contacting member r. This engaging force causes the cloth contactors 3*a*, 3*b* to rotate in either left or right direction centering around the supporting axes 2*a* and 2*b* thereof, corresponding to the orientation of the twist of the band-like cloth w, against the resiliency of a spring (not illustrated).

Only when the rotation exceeds a specified value, this is electrically detected and the detection is outputted as twist information.

While the twist information is being outputted, the motor 4*b* begins to rotate in a particular direction corresponding to the orientation of the twist. In line with this rotation, the cloth turning device 4 is caused to rotate, and the band-like cloth w is accordingly rotated in a direction for eliminating the twist existing at the position of the cloth contactors 3*a*, 3*b*. Therefore, while the band-like cloth w is moving, the twist thereof can be kept less than a specified level.

The conventional twist detecting device has been widely utilized in the field of the corresponding industry, and the same is beneficial, too.

However, since in this kind of device, the thickness of band-like cloth w to be handled is determined by the relative position and size of a pair of cloth contactors 3*a*, 3*b*, the scope of the use is comparatively narrow. Especially, if the thickness is very narrow less than the allowance thereof, the band-like cloth w may be engaged between a pair of cloth contactors 3*a*, 3*b*, there may be cases where a desired operation can not be achieved.

If a tensile force acting on the band-like cloth w is too strong and the cloth w is excessively strongly brought into contact with the cloth contactors 3*a*, 3*b* even though the thickness of the band-like cloth w is within the allowance, a part of the band-like cloth w may be also engaged between a pair of cloth contactors 3*a*, 3*b*, thereby causing smooth operation not to be acquired. Therefore, in order to prevent this, it is necessary that another means is provided in addition thereto.

SUMMARY OF THE INVENTION AND ADVANTAGES

In view of the abovementioned situations, it is therefore an object of the invention to provide a twist detecting device of band-like cloth and a twist eliminating machine thereof.

In order to achieve the object, a twist detecting device according to the invention is such that a cloth contactor is supported at each of a pair of supporting axes juxtaposed to each other. The arcuate contacting member of these cloth contactors is brought into contact with a part of the band-like cloth, which is turned rope-like by narrowing, in its circumferential direction. The respective cloth contactors are caused to rock and are displaced against the resiliency of a spring centering around the supporting axes by their engagement with wrinkle lines of the band-like cloth, and the rocking and displacement thereof are outputted as twist information of the band-like cloth, wherein a cloth intermediate contacting member which is brought into contact with a part of the band-like cloth in its circumferential direction is provided deep in a triangle-shaped space formed at the opposed sides of the arcuate contacting member of said pair of cloth contactor, so that the cloth intermediate contacting member is caused to rock centering around the intermediate supporting axes juxtaposed to each other between said pair of supporting axes.

At this time, the cloth intermediate contacting members are caused to rock and to be displaced against the resiliency of a spring around the intermediate supporting axes by their engagement of wrinkle lines of band-like cloth as well as the cloth contacting members, and the rocking and displacement are outputted as twist information of the band-like cloth.

In details, the arm length ratios of the lever principle at each of the operating channels of the cloth intermediate contacting member and cloth contacting member are made different from each other, whereby it is constructed that the cloth intermediate contacting member is caused to rock more than a fixed quantity with an external force which is smaller than the external force required for a fixed rocking of the cloth contacting member.

Furthermore, recesses are provided in the width of each circumferential face of a pair of cloth contacting members, and a cloth intermediate contacting member is positioned in each of the recesses.

On the other hand, a twist eliminating machine according to the invention is such that a cloth guide means is formed, which is capable of causing band-like cloth turned rope-like by narrowing to go upward till a fixed height and continuously to go down. A twist detecting device according to the invention is installed so as to detect a twist of the band-like cloth going downward, and a cloth turning device is provided, by which the rising band-like cloth is rotated in an appointed direction around the center line of the band-like cloth.

According to the invention, the following advantages can be acquired.

That is, since cloth intermediate contacting members are provided, band-like cloth is not engaged between a pair of cloth contacting members regardless of the degree of its thickness. Therefore, smooth twist detection can be achieved, and a mechanism related thereto can operate without any difficulty even though the band-like cloth is strongly pulled and are strongly brought into contact with cloth contacting members.

Especially, when the contacting between band-like cloth and a cloth contacting member or cloth intermediate contacting member is weak, the cloth intermediate contacting member can be acutely operated, wherein it is possible to accurately detect the twist of band-like cloth.

Since band-like cloth is brought into contact with cloth contactors and cloth intermediate contacting members in a well balanced state, accurate operations thereof can be achieved. According to the invention, the space required can be saved to cause the device to be made compact.

It is possible to speedily and accurately eliminate twist of band-like cloth by functions of the abovementioned twist detecting device, and since the twist detecting device is hardly influenced by limitations resulting from the thickness and tension of band-like cloth, it is possible to use the twist detecting device for band-like cloth in a wide range. Therefore, the twist detecting device can be used without any hindrance even in a case where band-like cloth is beaten by a beater at the downstream side of the device.

The rotation of a cloth turning device, which exceeds the necessity, can be suppressed, wherein it is possible to further speedily and accurately eliminate the twist of band-like cloth.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF PREFERRED EMBODIMENT

Figure 1:
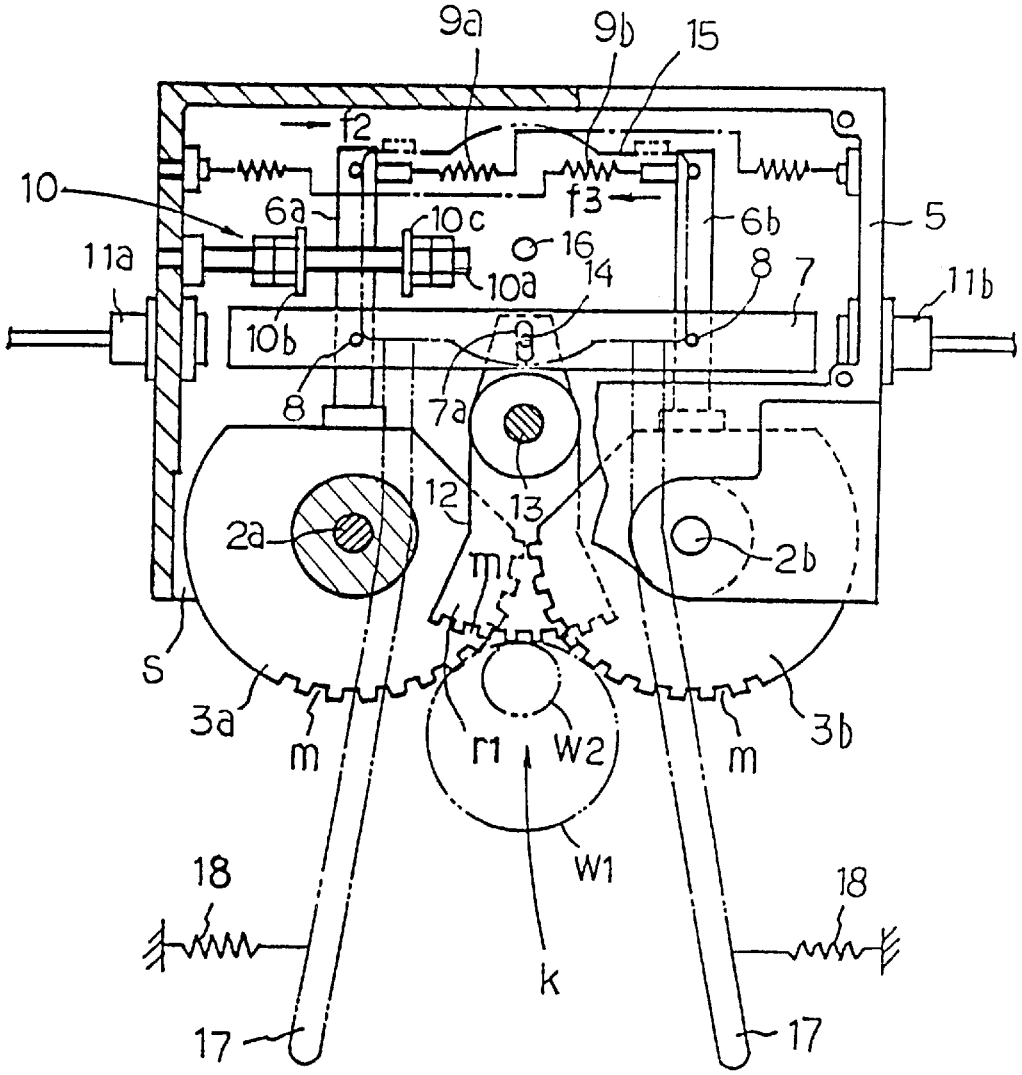
FIG. 1 is a view showing a state where the upper cover of a twist detecting device according to the invention is opened, with a part thereof shown with its cross-section.
Figure 2:
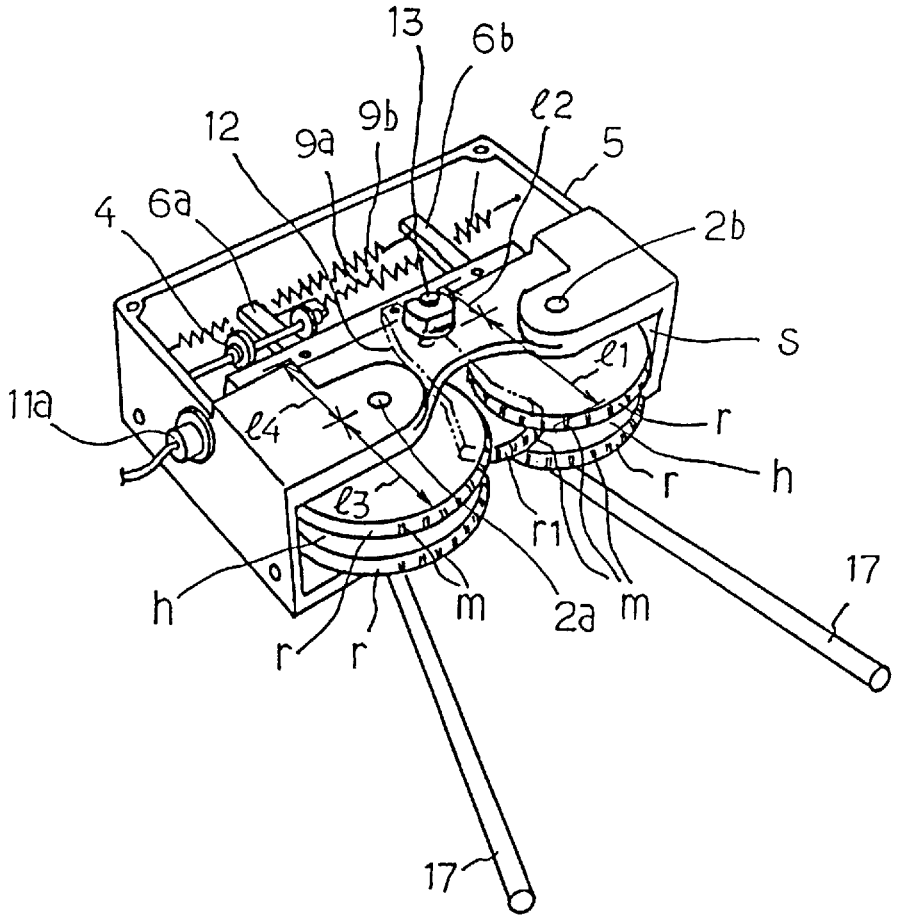
FIG. 2 is a perspective view showing the same twist detecting device.

Firstly, a description is given of a twist detecting device according to the invention. FIG. 1 is a plan view showing a state where the upper cover of the same twist detecting device is opened with a part thereof shown with its cross-section, and FIG. 2 is a perspective view of the same twist detecting device.

In FIG. 1, 5 is a box-like device frame, the front side s of which is open. A pair of supporting axes 2*a*, 2*b* are vertically provided at the position near the front side s in the device frame 5.

Each of the cloth contacting members 3*a*, 3*b* are made cylindrical, and an annular recess h is formed at the middle part in the width direction thereof on the circumference thereof. A number of vertical grooves m are formed at each of the arcuate contacting members r formed so as to be separate from each other by the recess h.

6*a* and 6*b* are arm members extending rearward from each of the cloth contacting members 3*a*, 3*b*. These arm members 6*a*, 6*b* are pivotally fixed at a linkage member 7 by axes 8, thereby causing both the arm members to be thus linked to each other.

9*a* is a spring applied between the tip end of one arm member 6*a* and the side of the device frame 5, and the spring 9*a* gives the arm member 6*a* a resiliency in the direction of the arrow f2.

9*b* is also a spring applied between the tip end of the other arm member 6*b* and the side of the device frame 5, and the spring 9*b* gives the arm member 6*b* a resiliency in the direction of the arrow f3.

10 is a means for limiting the rocking of one arm member 6*a* around the supporting axis 2*a* in a fixed range, and the means is constructed so that two limiting members 10*b*, 10*c* are screwed to a threaded rod 10*a* extending from the side of the device frame 5.

11*a* and 11*b* are existence sensors which detect an approach of the respective ends of the linkage member 7 when they approach within a fixed distance.

A cloth intermediate contacting member 12 is provided at a point, which will come in the recess h, existing deep in a triangle-shaped space k formed at the opposed points of the arcuate contacting member r of said pair of cloth contacting members 3*a*, 3*b*.

The cloth intermediate contacting member 12 is disposed at the middle part of the abovementioned supporting axes 2*a*, 2*b* and is supported by an intermediate supporting axis 13 made parallel to the supporting axes 2*a*, 2*b* fixed at the upper and lower sides of the device frame 5, and simultaneously the rear end of the intermediate contacting member 12 is linked with a long hole 7*a* formed at the central position of the middle member 7, by an axis 14 idly inserted into the long hole 7*a*.

At this time, the arcuate contacting member r1 of the cloth intermediate contacting member 12 is located deep in the abovementioned space k and is provided with a number of vertical grooves m. Furthermore, the ratio of the dimension l1 from the contacting member r1 to the cloth intermediate supporting axis 13 to the dimension l2 from the intermediate supporting axis 13 to the axis 14 is made smaller than the ratio of the dimension l3 from the arcuate contacting member r of the cloth contacting members 3*a*, 3*b* to the dimension l4 from the supporting axes 2*a*, 2*b* to the axis 8.

Furthermore, a roughly square swivel member 15 is attached to the bottom of the device frame 5 via an axis 16, and two regulation guide rods 17, 17 are attached to the swivel member 15 so as to open frontward, whereby they are caused to rock left or right around an axis 16 within a fixed range against the resiliency of springs 18, 18.

When using the abovementioned twist detecting device, band-like cloth w turned rope-like by narrowing is brought into contact with the arcuate contacting member r with adequate pressure and is fed and moved in either upward or downward direction.

At this time, when the band-like cloth is thick, the band-like cloth w1 is brought into contact with the arcuate contacting members r, r of two cloth contacting members 3*a*, 3*b* or the arcuate contacting member r and r1 of these contacting members 3*a*, 3*b* and cloth intermediate contacting member 12 with adequate pressure in its stabilized state. Furthermore, if the band-like cloth w1 is twisted, the cloth contacting members 3*a*, 3*b* and cloth intermediate contacting member 12 are caused to rock in the same direction around the supporting axes 2*a*, 2*b* and 13. With respect thereto, the linkage member 7 is displaced in either left or right direction. Thereby, the displacement thereof is detected by the existence sensors 11*a*, 11*b* and the detection signals are outputted as twist information.

During the use there are cases where the band-like cloth w1 is strongly brought into contact with the cloth contactors 3*a*, 3*b* due to a certain cause. In such cases, the band-like cloth w1 is supported by the arcuate contacting member r1 of the cloth intermediate contacting member 12, and the twist thereof can be smoothly detected without being engaged between the two cloth contactors 3*a*, 3*b*.

Contrarily, there are cases where the band-like cloth w1 is brought into contact with the cloth contactors 3*a*, 3*b*, etc. weaker than usual. In such cases, the detection capacity of the cloth contactors 3*a*, 3*b* is decreased. However, since it is possible for the cloth intermediate contacting member 12 to especially sensitively detect the twist with respect to the arm length in the lever principle, and the cloth intermediate contacting member 12 complementarily works with respect to the detection of the cloth contactors 3*a*, 3*b*, the twist can be accurately detected.

On the other hand, in a case where the band-like cloth is thinner than a specified thickness, the band-like cloth w2 is not able to be brought into contact with the two cloth contactors 3*a*, 3*b* in a stabilized state at the same time, and the band-like cloth w2 may be supported by only one cloth intermediate contacting member 12, or by only the cloth intermediate contacting member 12 and one cloth contactor 3*a* or 3*b*. Therefore, in this case, it is possible for the band-like cloth to be prevented from being engaged between two cloth contactors 3*a*, 3*b*, and the twist can be smoothly detected.

During the use, even though the contacting of the band-like cloth w2 with the cloth intermediate contacting member 12, etc. may be strong, the band-like cloth w2 can be securely supported by the cloth intermediate contacting member 12 without hindrance. Contrarily, if the contacting thereof is weak, the cloth intermediate contacting member 12 is able to sensitively detect the twist by the lever principle, whereby the twist can be detected without fail.

Figure 3:
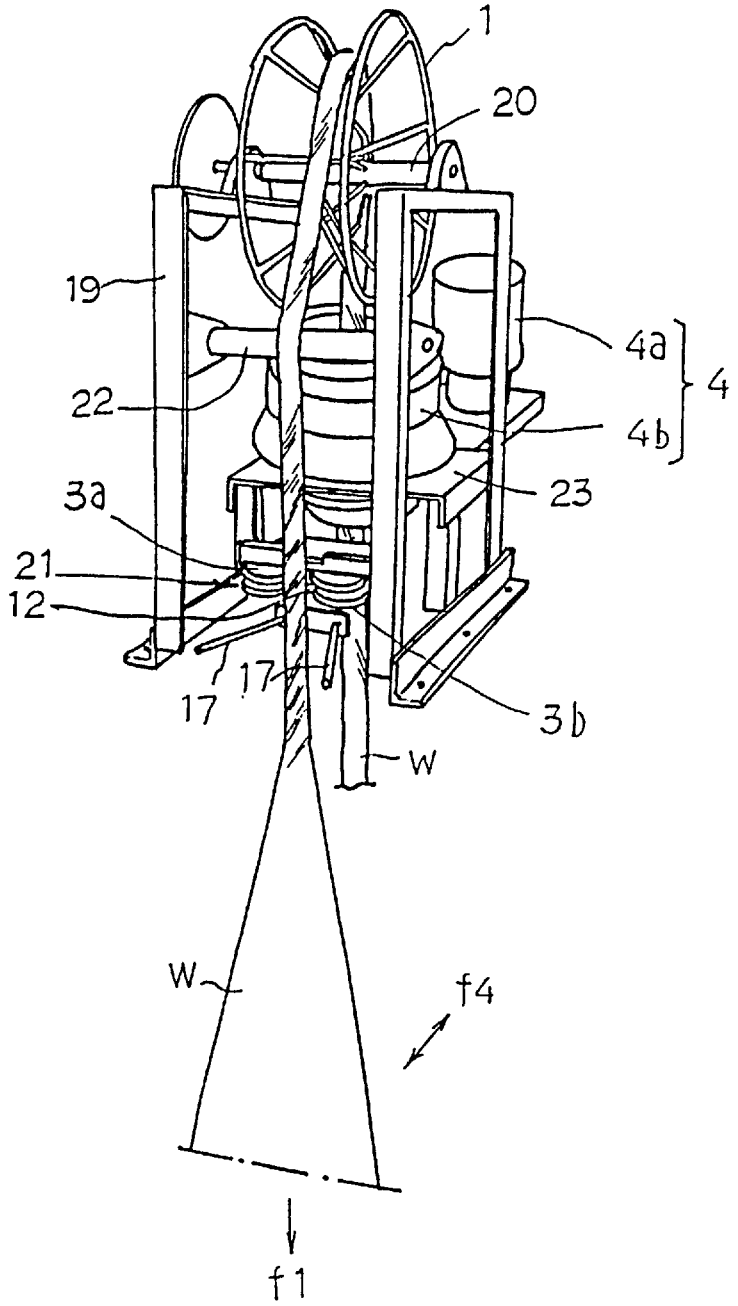
FIG. 3 is a view showing a twist eliminating machine according to the invention.
Figure 4:
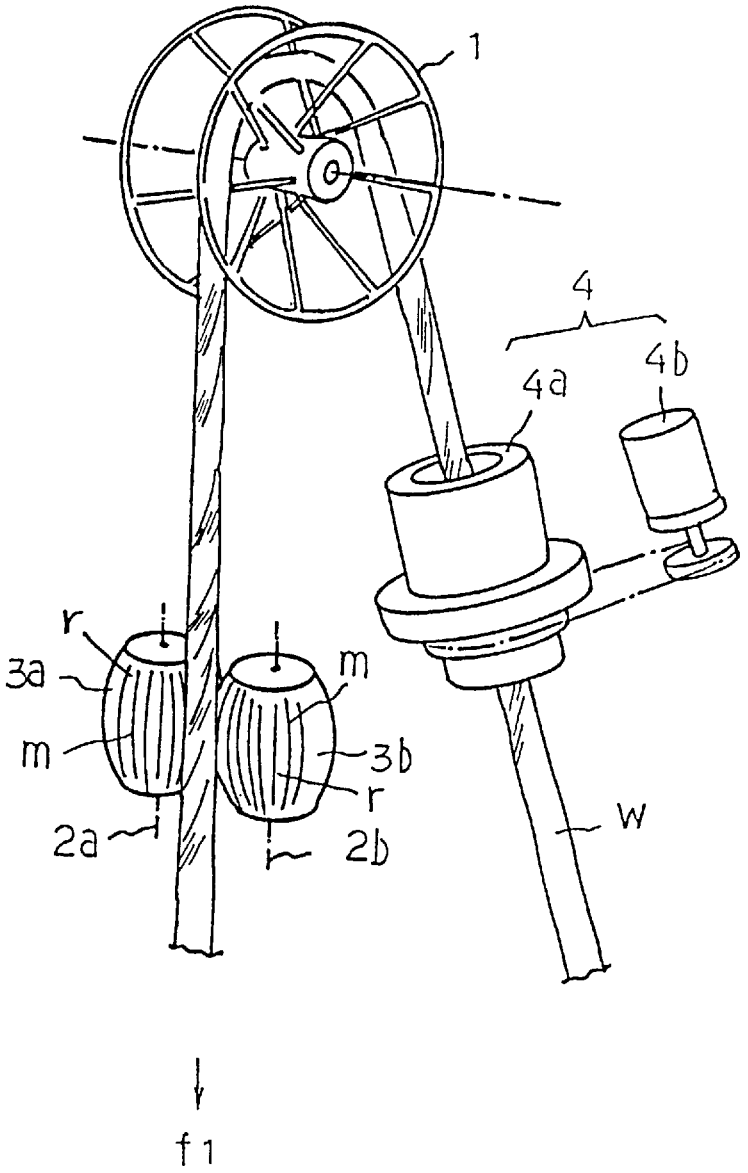
FIG. 4 PRIOR ART
FIG. 4 is a view showing the outline of a conventional twist eliminating machine.

A twist detecting device according to the invention, which is described above, can be used for, for example, with a twist eliminating machine, and the twist eliminating machine is shown in FIG. 3 in details.

In FIG. 3, 19 is a frame, and a guide wheel 1 is rotatably attached to a horizontal shaft 20 on the upper part of the frame 19, wherein a twist detecting device 21 constructed as described above is provided at the front lower part of the frame, and a cloth guide roller 22 is provided at a little upper position of the twist detecting device 21. 23 is a supporting plate on which a cloth turning device 4 is installed.

Furthermore, a cloth spreading device and a cloth feeding device, etc., which are similar to those in prior arts are provided at the lower part of the leading edge side of band-like cloth w.

When using the abovementioned twist eliminating device, band-like cloth w is led in the order of cloth turning device 4*a*, cloth guide wheel 1, roller 22, and twist detecting device 21. And the cloth feeding device causes the band-like cloth w to be sent out in the direction of the arrow f1.

While the band-like cloth w is moving, a spreading device operates at the downstream side of the twist detecting device 21. Therefore, the band-like cloth w is continuously spread to become like a triangle as shown in FIG. 3. At this time, the twist of band-like cloth is accumulated at the part right after the roller 22.

This twist is detected by the cloth contactors 3*a*, 3*b* and cloth intermediate contacting member 12 of the twist detecting device 21, and if the twist accumulation exceeds a fixed level, either one of the existence sensors 11*a* and 11*b* corresponding to the orientation of the twist begins to operate, whereby during the operation thereof, a motor 4*b* is rotated in a specified direction corresponding to the sensor 11*a* or 11*b* to cause the cloth turning device 4*b* to rotate in a direction for eliminating the twist.

Thereby, the band-like cloth w is twisted at a position corresponding to the cloth turning device 4*a*, and the twisting thereof is transmitted downward of the roller 22 through a guide wheel 1, and functions so as to eliminate the twist accumulated thereat.

The abovementioned operation is continuously carried out during the feeding of band-like cloth w. Therefore, the twisting immediately after the roller 22 is always kept to be less than a fixed level.

During such operations, although the band-like cloth w irregularly rocks left and right at the position of the twist detecting device 21, or irregularly rocks frontward and backward in the direction f4, or the contacting with the cloth contactors 3*a*, 3*b*, etc. may be changed, or the contacting position with cloth contactors 3*a*, 3*b* may be changed, the twist can be effectively eliminated by the operations of the cloth intermediate contacting members 12.

Furthermore, in order to effectively carry out a spreading operation by a cloth spreading device, a beater is provided downward of the twist detecting device, whereby the front surface of cloth is continuously beaten. In this case, the twist can be eliminated without any trouble.

Still furthermore, the thickness of band-like cloth w may change according to the size of the band-like cloth w to be treated, and the tension of band-like cloth w may differ according to the material thereof. In these cases, even though the relative arrangement and shape of the respective components are not changed, a twist detecting device and a twist eliminating machine according to the invention can be applicable in a wide range of applications.

Moreover, if the band-like cloth w greatly rocks left or right, the rocking can be limited by the regulation guide rods 17, 17.

At this time, when band-like cloth w extraordinarily strongly presses the regulation guide rods 17, 17 due to a certain reason to cause the regulation guide rods 17, 17 to greatly rock left or right against the resiliency of springs 18, 18, this rocking is detected by a sensor (not illustrated) to thereby cause the cloth feeding device to stop. This stop is cancelled by a resetting operation after the cause is eliminated.

Since according to the invention the operating position of the twist detecting device 21 is different from that of the cloth turning device 4 with respect to the band-like cloth w, and a time lag exists between the related operations of the devices 21 and 4, there is a case where the cloth turning device 4 turns the band-like cloth w more excessively than the necessity, and such a tendency frequently occurs especially when the band-like cloth is less twisted.

In order to suppress this tendency, a detection time judging device is further provided, which is able to judge the time during which the twist of band-like cloth w in either left or right direction is continuously detected by a twist detecting device 21, that is, the continuous detection time of twist, and a turning control device is provided, which is able to rotate the cloth turning device 4 intermittently in an appointed direction at a time interval relative to the result of judgement of the abovementioned judging device.

Thereby, the continuous rotation time of the cloth turning device 4 is made longer in proportion to the length of the abovementioned continuous detection time of twist. At this time, the intermittent continuous stop time may be adequately changed with respect to the length of the continuous detection time of twist or may be always fixed at a fixed time (for example, 0.8 to 1.0 seconds).

In such a mechanism, if twist in either left or right orientation is continuously detected by a twist detection device 21 for a comparatively longer period of time, it is repeated that the cloth turning device 4 stops for a fixed time and is continuously rotated for a comparatively long period of time, resulting in such an operation similar to the cloth turning device 4 being rotated at a high speed. Contrarily, if twist in either left or right orientation is detected for a comparatively shorter period of time, it is repeated that the cloth turning device 4 stops for a fixed time and is rotated for a comparatively short period of time, resulting in such an operation similar to the cloth turning device 4 being rotated at a low speed.

Therefore, the twist of band-like cloth w is quickly eliminated if the same is large, and the twist thereof is slowly eliminated if the same is small, thereby causing an adequate treatment (elimination of the twist) to be executed without any excess or shortage.

Obviously, many modifications and variations of the present invention are possible in light of the above teachings. It is, therefore, to be understood that within the scope of the appended claims the invention may be practiced otherwise than as specifically described.

What is claimed is:

1. A twist detecting device for detecting twists in a moving band of cloth turned in around its axis of movement by engaging wrinkle lines in the cloth comprising:

a pair of juxtaposed supporting axes;

a cloth contactor supported at each of the supporting axes, each cloth contactor having an arcuate contacting portion for contacting the moving band of cloth, said arcuate contacting portions extending toward one another to define a nip;

a spring biasing each of the cloth contactors in a first circumferential direction around its supporting axis to an initial position;

a cloth intermediate contacting member rockably supported about a supporting axis and positioned between said arcuate contacting portions of said cloth contactor, adjacent to said nip, said cloth contactors and said cloth intermediate contacting member pivoting around their supporting axes in response to engaging wrinkle lines in the moving band of cloth; and an arrangement for outputting the pivoting of said cloth contactors and said cloth intermediate contacting member about their axes as information about twists in the moving band of cloth.

2. A twist detecting device according to claim 1, wherein said cloth contactors and said cloth intermediate contacting member each have a pivotal connection with a common displaceable linkage member, said cloth intermediate contacting member has a contacting portion for contacting the moving band of cloth, each cloth contactor defines a first lever arm between its arcuate contacting portion and its supporting axis and a second lever arm between its supporting axis and its pivotal connection with the common displaceable linkage member, and said cloth intermediate contacting member defines a first lever arm between its contacting portion and its supporting axis and a second lever arm between its supporting axis and its pivotal connection with the common displaceable linkage member, wherein the ratio of the first to the second lever arms of the intermediate contacting member is different from the ratio of the first to the second lever arms of the cloth contactors, whereby the intermediate contacting member is pivoted about its axis with less force than a force required to pivot the intermediate contacting members around their axes.

3. A twist detecting device as set forth in claim 1, wherein an arcuate recess is defined in the arcuate contacting portion of each of said cloth contactors, and said cloth intermediate contacting member extends into said recesses.

4. A twist eliminating machine for eliminating twists in a moving band of cloth turned in around its axis of movement comprising:

a cloth guide arrangement for guiding the moving band of cloth in a first direction in a first run of the band and in a second direction in a second run of the band;

a pair of juxtaposed supporting axes;

a cloth contactor supported at each of the supporting axes, each cloth contactor having an arcuate contacting portion for contacting the moving band of cloth, said arcuate contacting portions extending toward one another to define a nip;

a spring biasing each of the cloth contactors in a first circumferential direction around its supporting axis to an initial position;

a cloth intermediate contacting member rockably supported about a supporting axis and positioned between said arcuate contacting portions of said cloth contactor, adjacent to said nip, said cloth contactors and said cloth intermediate contacting member pivoting around their supporting axes in response to engaging wrinkle lines in the moving band of cloth;

an arrangement for outputting the pivoting of said cloth contactors and said cloth intermediate contacting member about their axes as information about twists in the moving band of cloth; and a cloth turning arrangement for turning the band in the first run in a direction around axis of movement of the band in response to twist detected by the twist detecting device.

5. A twist eliminating machine as set forth in claim 4, further comprising:

a detection time judging means for judging the time during which the twist is continuously detected by the twist detecting device; and means for operating said cloth turning device to intermittently turn the band in an appointed direction around the axis of movement of the band for a time period whose duration is dependent on the length of the time during which the twist is continuously detected by the twist detecting device.

6. A twist detecting device for detecting twists in a moving band of cloth turned in around its axis of movement by engaging wrinkle lines in the cloth comprising:

a pair of juxtaposed supporting axes;

a cloth contactor supported at each of the supporting axes, each cloth contactor having an arcuate contacting portion for contacting the moving band of cloth, said arcuate contacting portions extending toward one another to define a nip;

a spring biasing each of the cloth contactors in a first circumferential direction around its supporting axis to an initial position;

a cloth intermediate contacting member rockably supported about a supporting axis and positioned between said arcuate contacting portions of said cloth contactor, adjacent to said nip, said cloth contactors and said cloth intermediate contacting member pivoting around their supporting axes in response to engaging wrinkle lines in the moving band of cloth; and means for outputting the pivoting of said cloth contactors and said cloth intermediate contacting member about their axes as information about twists in the moving band of cloth.

7. A twist detecting device according to claim 6, wherein said cloth contactors and said cloth intermediate contacting member each have a pivotal connection with a common displaceable linkage member, said cloth intermediate contacting member has a contacting portion for contacting the moving band of cloth, each cloth contactor defines a first lever arm between its arcuate contacting portion and its supporting axis and a second lever arm between its supporting axis and its pivotal connection with the common displaceable linkage member, and said cloth intermediate contacting member defines a first lever arm between its contacting portion and its supporting axis and a second lever arm between its supporting axis and its pivotal connection with the common displaceable linkage member, wherein the ratio of the first to the second lever arms of the intermediate contacting member is different from the ratio of the first to the second lever arms of the cloth contactors, whereby the intermediate contacting member is pivoted about its axis with less force than a force required to pivot the intermediate contacting members around their axes.

8. A twist detecting device as set forth in claim 6, wherein an arcuate recess is defined in the arcuate contacting portion of each of said cloth contactors, and said cloth intermediate contacting member extends into said recesses.

9. A twist eliminating machine for eliminating twists in a moving band of cloth turned in around its axis of movement comprising:

cloth guide means for guiding the moving band of cloth in a first direction in a first run of the band and in a second direction in a second run of the band;

a pair of juxtaposed supporting axes;

a cloth contactor supported at each of the supporting axes, each cloth contactor having an arcuate contacting portion for contacting the moving band of cloth, said arcuate contacting portions extending toward one another to define a nip;

a spring biasing each of the cloth contactors in a first circumferential direction around its supporting axis to an initial position;

a cloth intermediate contacting member rockably supported about a supporting axis and positioned between said arcuate contacting portions of said cloth contactor, adjacent to said nip, said cloth contactors and said cloth intermediate contacting member pivoting around their supporting axes in response to engaging wrinkle lines in the moving band of cloth;

means for outputting the pivoting of said cloth contactors and said cloth intermediate contacting member about their axes as information about twists in the moving band of cloth; and cloth turning means for turning the band in the first run in a direction around the axis of movement of the band in response to twist detected by the twist detecting device.

10. A twist eliminating device as set forth in claim 9, further comprising:

a detection time judging means for judging the time during which the twist is continuously detected by the twist detecting device; and means for operating said cloth turning device to intermittently turn the band in an appointed direction around the axis of movement of the band for a time period whose duration is dependent on the length of the time during which the twist is continuously detected by the twist detecting device.

* * * * *